US008567341B1

(12) United States Patent
Thies

(10) Patent No.: US 8,567,341 B1
(45) Date of Patent: Oct. 29, 2013

(54) SUPPLY CHANGING APPARATUS FOR POWDER COATING SYSTEMS

(75) Inventor: Michael J. Thies, Indianapolis, IN (US)

(73) Assignee: Gema Switzerland GmbH (CH)

( * ) Notice: Subject to any disclaimer, the term of this patent is extended or adjusted under 35 U.S.C. 154(b) by 1367 days.

(21) Appl. No.: 12/059,642

(22) Filed: Mar. 31, 2008

(51) Int. Cl.
*B05B 7/26* (2006.01)
*B05D 1/12* (2006.01)

(52) U.S. Cl.
USPC ..... 118/310; 427/180

(58) Field of Classification Search
USPC ..... 118/310, 311
See application file for complete search history.

(56) References Cited

U.S. PATENT DOCUMENTS

| | | | | |
|---|---|---|---|---|
| 3,674,207 | A * | 7/1972 | Carbonetti et al. | 239/69 |
| 3,924,810 | A | 12/1975 | Otterstetter | |
| 6,315,214 | B1 | 11/2001 | Fingleton et al. | |
| 6,705,545 | B1 | 3/2004 | Sroka et al. | |
| 6,755,913 | B1 * | 6/2004 | Kobayashi et al. | 118/620 |
| 6,942,161 | B2 | 9/2005 | Shimada | |
| 6,945,470 | B2 | 9/2005 | Kia et al. | |
| 7,005,159 | B2 | 2/2006 | Ciarelli et al. | |
| 7,074,274 | B1 | 7/2006 | Shutic et al. | |
| 7,134,573 | B2 | 11/2006 | Post | |
| 7,273,339 | B2 | 9/2007 | Johnson et al. | |
| 2004/0060510 | A1 * | 4/2004 | Ciarelli et al. | 118/308 |
| 2004/0159724 | A1 | 8/2004 | van der Steur | |
| 2005/0028867 | A1 | 2/2005 | Ciarelli | |
| 2005/0279860 | A1 | 12/2005 | Fulkerson et al. | |
| 2006/0219807 | A1 | 10/2006 | Fulkerson et al. | |
| 2007/0095852 | A1 | 5/2007 | Murphy | |

FOREIGN PATENT DOCUMENTS

| | | | |
|---|---|---|---|
| EP | 1245295 | | 10/2002 |
| WO | WO 00/029124 | | 5/2000 |
| WO | WO 02/078861 | A1 | 10/2002 |
| WO | WO 2004/050259 | | 6/2004 |
| WO | WO 2006/052741 | A2 | 5/2006 |
| WO | WO 2007/067891 | A1 | 6/2007 |

OTHER PUBLICATIONS

International Search Report for Application No. PCT/US2006/061607 dated Mar. 21, 2007 related to Document No. WO 2007/067891 A1.

International Search Report for PCT/US2009/033893.

* cited by examiner

*Primary Examiner* — Dah-Wei Yuan
*Assistant Examiner* — Charles Capozzi
(74) *Attorney, Agent, or Firm* — Levenfeld Pearlstein, LLC

(57) ABSTRACT

A powder coating system comprising a plurality of supply containers and a connection changer having a plurality of supply connectors associated with a support member and each in fluid communication with at least one of the plurality of supply containers. The connection changer includes a movable delivery connector selectively and independently connectable to each of the plurality of supply connectors associated with the support member. A pump is in fluid communication with the delivery connector of the connection changer and at least one applicator is in fluid communication with the pump. Fluid communication from the delivery connector to the applicator defines a delivery portion of the system. The pump is disposed along the delivery portion of the system to apply negative pressure to the at least one selected supply container and draw its contents to the at least one applicator.

10 Claims, 7 Drawing Sheets

FIG. 3
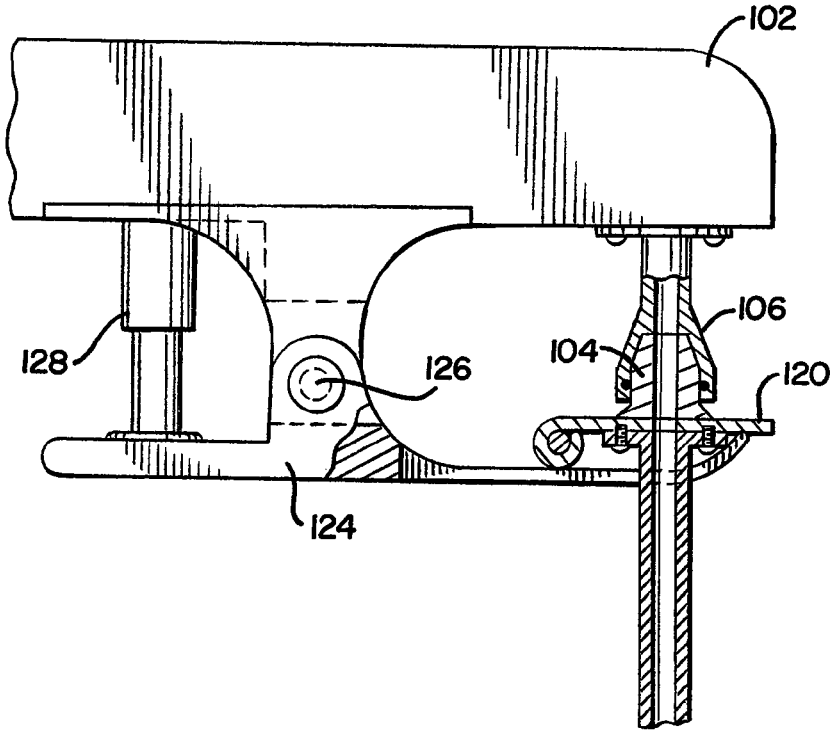
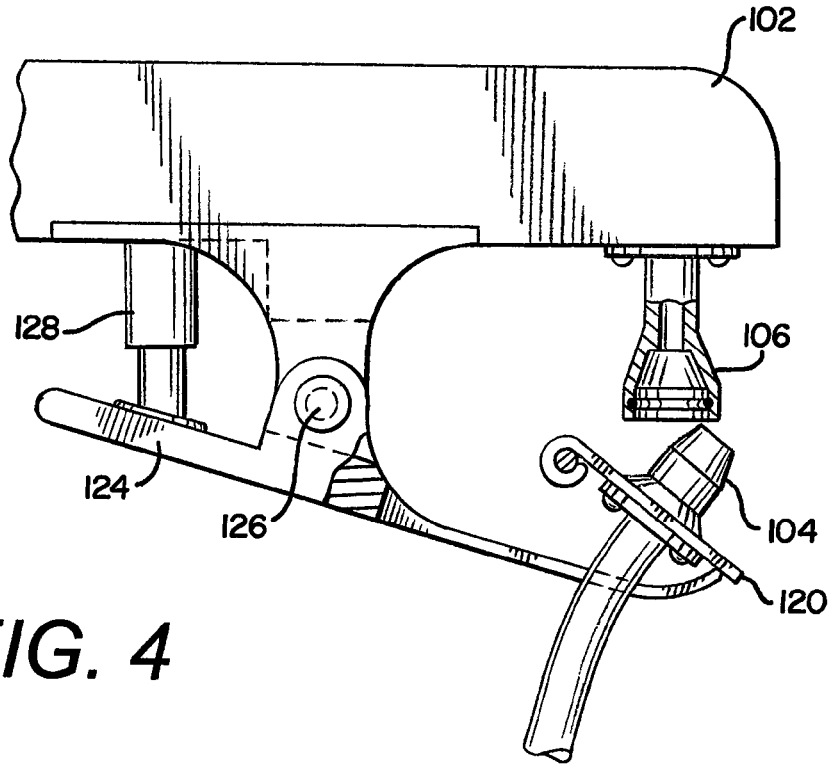
FIG. 4

SUPPLY CHANGING APPARATUS FOR POWDER COATING SYSTEMS

TECHNICAL FIELD

The present invention relates to material application systems, and more particularly to powder coating systems employing multiple supply containers in fluid communication with one or more applicators and a supply changing apparatus, which effectuates a change of supply containers to change, for example, the color of the powder being applied.

BACKGROUND OF THE INVENTION

Presently known powder coating systems typically employ complex and costly valve mechanisms, manifold systems, and multiple pumps to facilitate the change between, and use of, multiple supply containers in connection with one or more applicators. Many of these systems involve time consuming reconfiguration of equipment to effectuate a supply change. There is a need for simpler, more efficient, and less costly apparatus for changing supply containers within a powder coating system. The present invention addresses these and other needs, as will become apparent from the following detailed description and accompanying drawings.

SUMMARY OF THE INVENTION

According to a particular aspect of the present invention, a powder coating system comprises a plurality of supply containers and a connection changer having a plurality of supply connectors each in fluid communication with at least one of the plurality of supply containers. The connection changer includes a movable delivery connector selectively and independently connectable to each of the plurality of supply connectors. Fluid communication from the plurality of supply containers to the plurality of supply connectors defines a supply portion of the system. A pump is in fluid communication with the delivery connector of the connection changer and at least one applicator is in fluid communication with the pump. Fluid communication from the delivery connector to the applicator defines a delivery portion of the system. The pump is disposed along the delivery portion of the system to apply negative pressure to the at least one selected supply container and draw its contents to the at least one applicator.

According to another aspect of the present invention, a supply changing apparatus for use in a powder coating system comprises a supply connector arrangement having a plurality of supply connectors each connectable to at least one supply line associated with at least one of a plurality of supply containers of the system. The supply changing apparatus also includes a carriage member having a delivery connector positioned adjacent to the supply connector arrangement to facilitate connection with one of the plurality of supply connectors. The carriage member is connectable to a delivery line associated with a pump in communication with at least one applicator of the system. The supply changing apparatus also includes a track arrangement carrying the carriage member and allowing it to move from one of the plurality of supply connectors to another of the plurality of supply connectors.

According to another aspect of the present invention, a powder coating system comprises a plurality of supply containers and a connection changer. The connection changer comprises: a plurality of supply connectors mounted in a common arrangement and each in fluid communication with at least one of the plurality of supply containers, a delivery connector disposed adjacent to the plurality of supply connectors and selectively and independently connectable to each of the plurality of supply connectors, and a movement apparatus for carrying the delivery connector and allowing it to move from one of the plurality of supply connectors to another of the plurality of supply connectors. The powder coating system further comprises a pump in direct fluid communication with the delivery connector of the connection changer. At least one applicator is in fluid communication with the pump. The pump applies negative pressure to the at least one selected supply container to draw its contents to the at least one applicator.

Other aspects of the present invention will become apparent and be more fully understood from the following detailed description and accompanying drawings, which set forth illustrative embodiments indicative of some of the various ways in which the principals of the invention may be employed.

BRIEF DESCRIPTION OF THE DRAWINGS

FIG. 3 is a partial elevational view of a delivery connector head having a delivery connector in engagement with a supply connector in accordance with one or more principles of the present invention.

FIG. 4 is a partial elevational view of a delivery connector head having a delivery connector disengaged from a supply connector in accordance with one or more principles of the present invention.

DETAILED DESCRIPTION OF THE PREFERRED EMBODIMENTS

Figure 1:
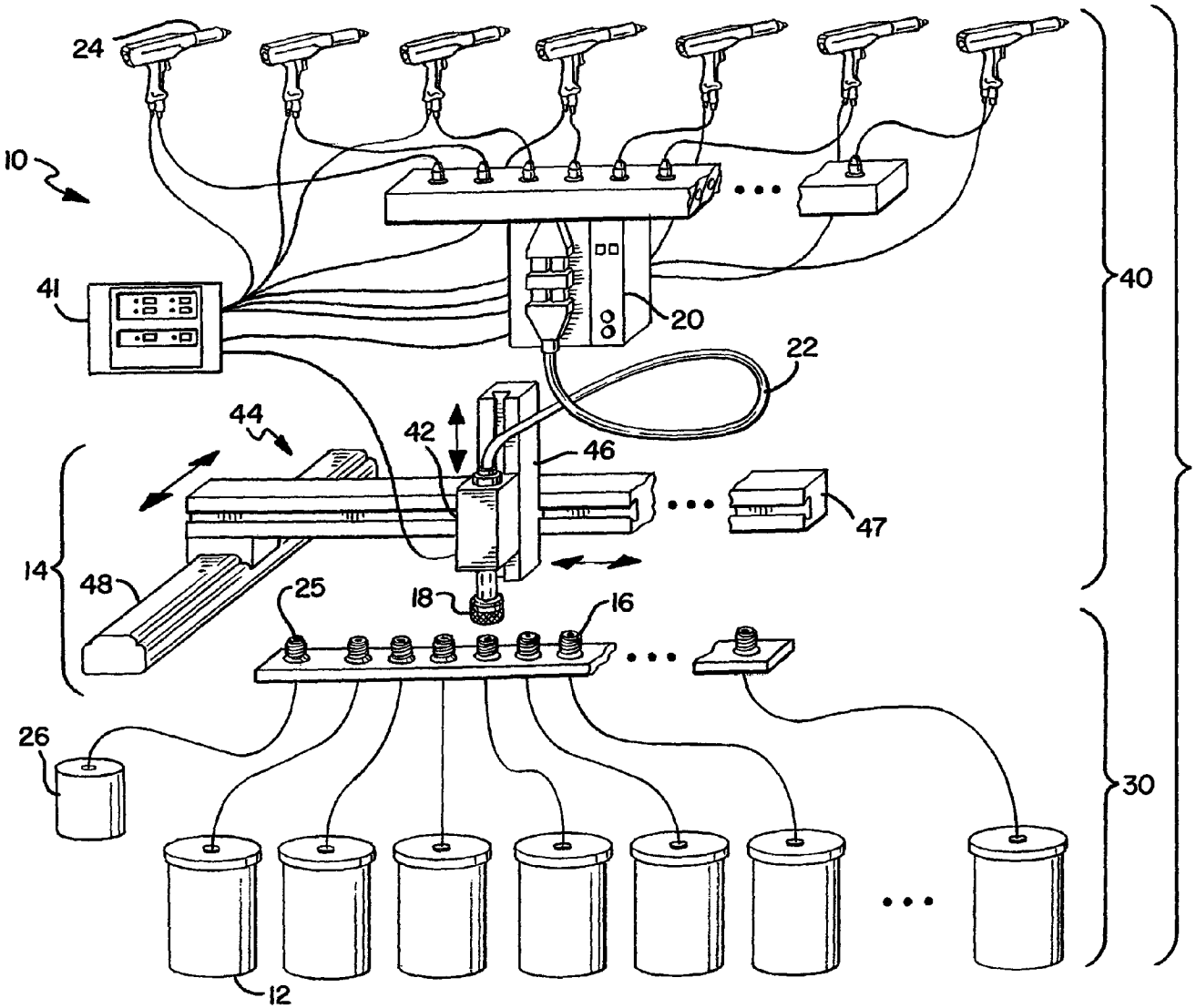
FIG. 1 is a perspective view of an embodiment of a powder coating system in accordance with one or more principles of the present invention.

The description that follows describes, illustrates and exemplifies one or more particular embodiments of the present invention in accordance with one or more of its principles. This description is not provided to limit the invention to the embodiments described herein, but rather to explain and teach the principles of the invention in such a way to enable one of ordinary skill in the art to understand these principles and, with that understanding, be able to apply them to practice not only the embodiments described herein, but also other embodiments that may come to mind in accordance with these principles. The scope of the present invention is intended to cover all such embodiments that may fall within the scope of the appended claims, either literally or under the doctrine of equivalents.

It should be noted that in the description and drawings, like or substantially similar elements may be labeled with the same reference numerals. However, sometimes these elements may be labeled with differing numbers, such as, for example, in cases where such labeling facilitates a more clear description. Additionally, the drawings set forth herein are not necessarily drawn to scale, and in some instances proportions may have been exaggerated to more clearly depict certain features. Such labeling and drawing practices do not necessarily implicate an underlying substantive purpose. The present specification is intended to be taken as a whole and interpreted in accordance with the principles of the present invention as taught herein and understood to one of ordinary skill in the art.

In accordance with one or more principles of the present invention, an embodiment of a powder coating supply system 10 is illustrated in FIG. 1. In the particular embodiment of FIG. 1, the system 10 includes a plurality of supply containers 12 and a connection changer 14 having a plurality of supply connectors 16 each in fluid communication with at least one of the supply containers 12. The connection changer 14 includes a movable delivery connector 18 selectively and independently connectable to each of the supply connectors 16. The supply connectors 16 and the mating delivery connector 18 can be of any type known in the art and can utilize any type of connection mechanism known in the art. A pump 20 is in fluid communication with the delivery connector 18 of the connection changer 14 via delivery line 22. At least one applicator 24 is in fluid communication with the pump 20 to apply negative pressure to the selected supply container(s) and draw the contents of the supply container(s) to the applicator 24. In a preferred embodiment, the pump 20 is a dense phase pump. In a preferred embodiment, at least one supply connector is deemed to be a purge connector 25 in fluid communication with a positive pressure source 26 to purge a connected applicator 24 when the delivery connector 18 is connected to the purge connector 25.

As illustrated in FIG. 1, fluid communication from the plurality of supply containers 12 to the plurality of supply connectors 16 defines a supply portion 30 of the system. Fluid communication from the delivery connector 18 to the applicator(s) 24 defines a delivery portion 40 of the system. According to a particular aspect of the invention, the pump 20 is disposed along the delivery portion 40 of the system 10, as opposed to the supply portion 30 of the system 10. Among other things, the disposition of the pump 20 along the delivery portion 40 of the system 10 eliminates the need for costly valve control assemblies and multiple pumps for each of the supply containers. The pump 20, however, may be disposed along the supply portion 30 of the system 10 in accordance with other aspects of the invention.

Referring to FIG. 1, the system 10 includes a control unit 41 in communication with the pump, the connection changer, and/or the applicator(s). The control unit can be a microprocessor-based controller or computer, a programmable logic controller (PLC), or other control unit known in the art, including, but not limited to hardware, software, and firmware based controllers, or a combination thereof. Movement of any of the components of the system can be facilitated by any means known in the art, such as, for example, servomotors, electric motors, gear mechanisms, belt drives, magnetic drives, rack and pinion type engagements, pneumatic-assisted mechanisms, or the like, alone or in combination. All of these can be controlled by the controller 41 by methods known in the art. The control unit 41 can be configured to control one or more aspects of the system, including, but not limited to, control of the connection changer and associated movements, control of the pump, and control of the applicator (s).

Referring again to FIG. 1, in a preferred embodiment, the connection changer 14 includes a carriage member in the form of a delivery connector head 42 positioned adjacent to the arrangement of supply connectors 16 to facilitate connection between the delivery connector 18 and the supply connectors 16. The delivery connector head 42 includes the delivery connector 18, which is connected to the delivery line 22. In a preferred embodiment, the connection changer 14 includes a movement apparatus in the form of a track arrangement 44 for facilitating movement of the delivery connector head 42 and associated delivery connector 18 with respect to the arrangement of supply connectors 16. As shown in FIG. 1, the arrangement of supply connectors 16 is in a linear format arranged in a generally common plane opposing the delivery connector 18. The arrangement, however, can take any form, such as, for example, a matrix format. In the embodiment shown in FIG. 1, the track arrangement 44 includes a first track member 46 for carrying the delivery connector head 42 linearly in a direction generally transverse to the generally common plane of the supply connector arrangement to facilitate connection with the supply connectors 16. In the embodiment shown in FIG. 1, the track arrangement also includes a second track member 47 for carrying the first track member 46 and the delivery connector head 42 linearly in a direction generally parallel to the generally common plane of the supply connector arrangement. In the embodiment shown in FIG. 1, the track arrangement also includes a third track member 48 for carrying the second track member 47 linearly in a direction transverse to the direction generally parallel to the generally common plane of the supply connector arrangement.

Figure 2:
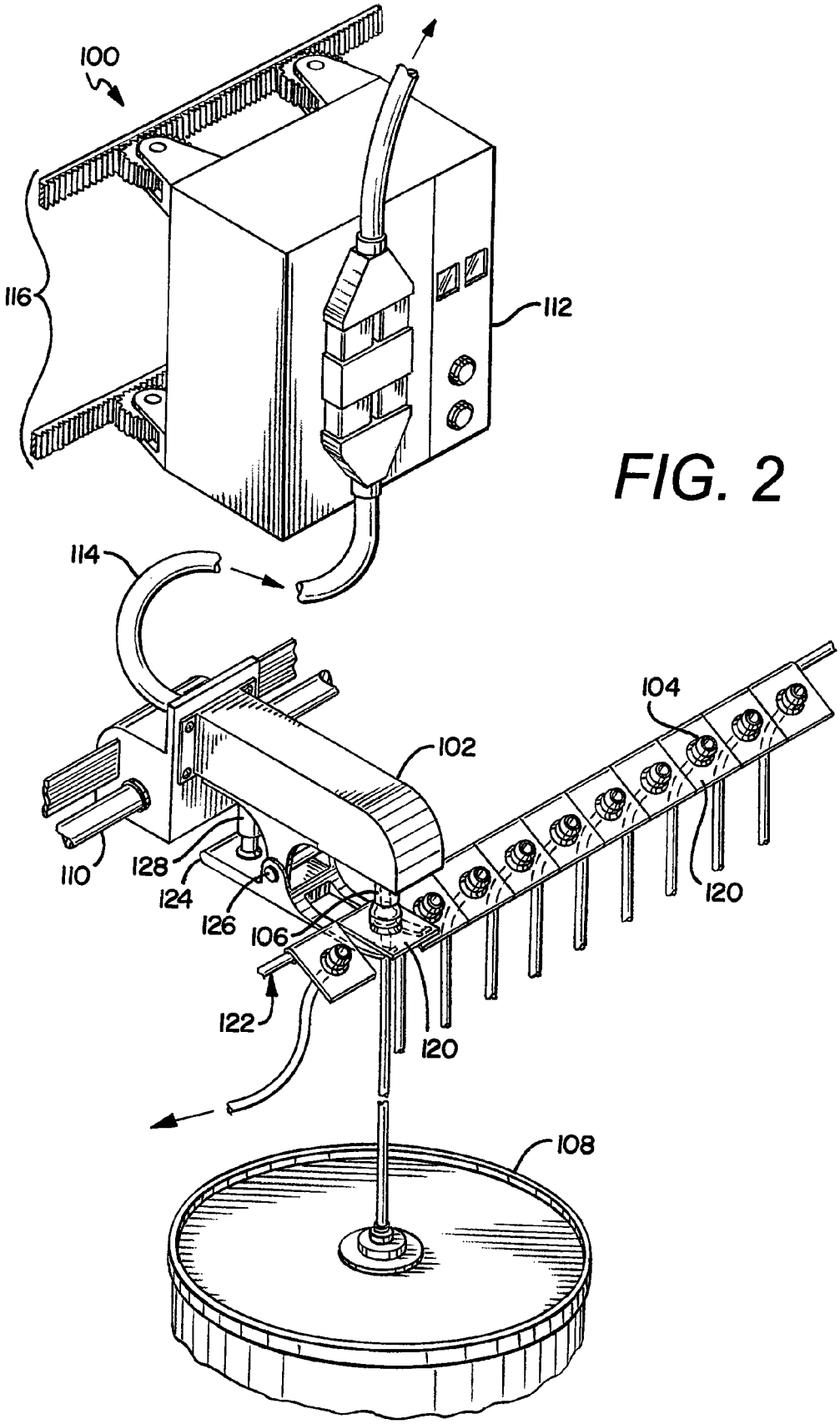
FIG. 2 is a perspective view of another embodiment of a powder coating system in accordance with one or more principles of the present invention.

In accordance with one or more principles of the present invention, portions of another embodiment of a powder coating supply system 100 are illustrated in FIG. 2. In the embodiment shown in FIG. 2, a carriage member in the form of a delivery connector head 102 is positioned adjacent to an arrangement of supply connectors 104 to facilitate connection between a delivery connector 106 and the supply connectors 104. As shown in FIG. 2, the arrangement of supply connectors 104 is in a linear format arranged generally opposing the delivery connector 18. Each of the supply connectors are in fluid communication with one or more supply containers 108 to facilitate supply of powder coating to one or more applicators (not shown). The delivery connector head 102 is moveable via a movement apparatus in the form of a carriage track 110 to facilitate movement of the delivery connector with respect to the arrangement of supply connectors. A pump 112 is in fluid communication with the delivery connector via delivery line 114. The pump is arranged to move relative to the plurality of supply connectors via a second movement apparatus in the form of a track mechanism 116.

In the embodiment shown in FIG. 2, each of the plurality of supply connectors 104 are mounted to a flipper member 120 that allows the supply connector 104 to pivot about a pivot axis 122 to facilitate movement toward the delivery connector 106 on the delivery connector head 102. As shown in more detail in FIGS. 3 and 4, the delivery connector head includes a lever member 124 that is separately engageable with each of the flipper members 120 to cause it to pivot about the pivot axis 122 and draw the supply connector 104 toward the delivery connector 106 for engagement therewith. In the embodiment shown in FIG. 2, the lever member 124 pivots about a pivot axis 126 and is caused to pivot by an actuation member 128. Other mechanisms or arrangements known in the art may also be employed to facilitate movement of the supply connector 104 relative to the delivery connector 106.

Figure 5:
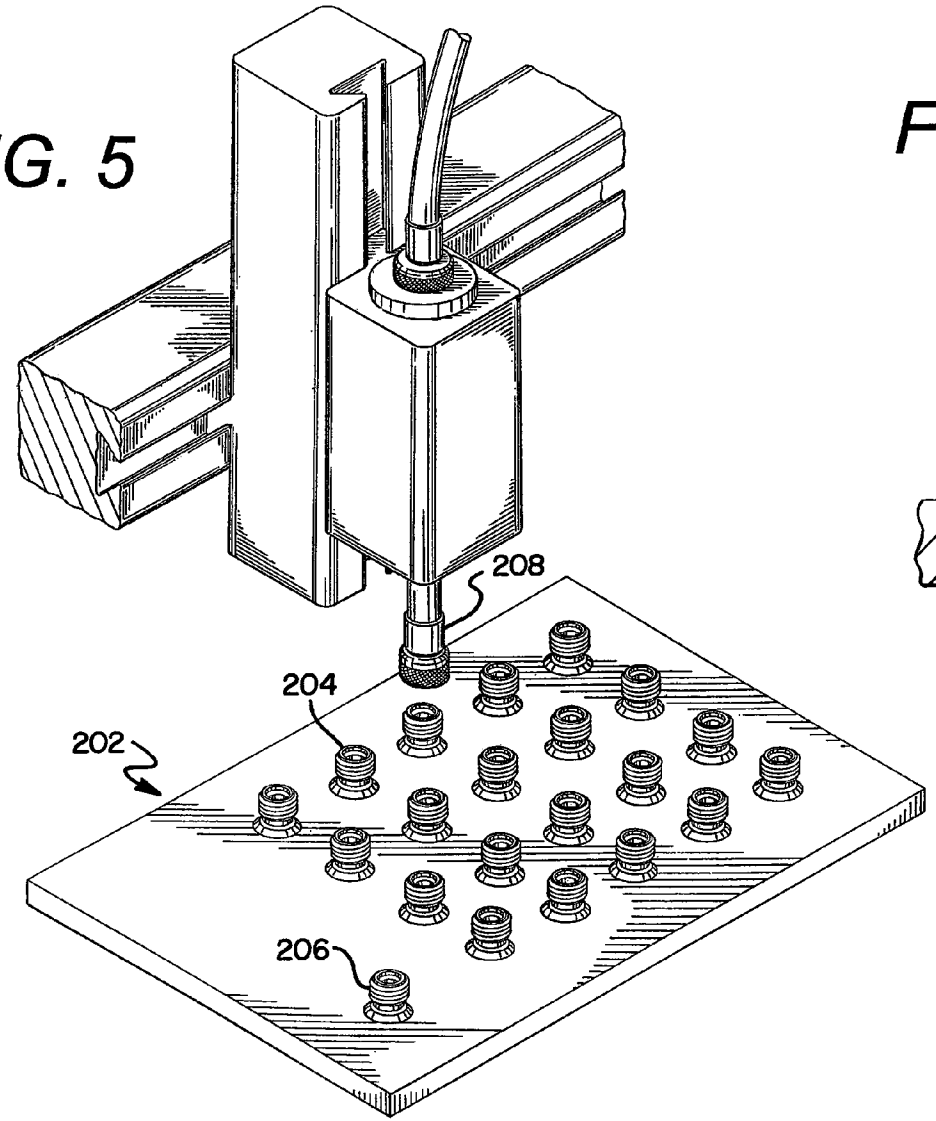
FIG. 5 is a perspective view of yet another embodiment of a connection changing apparatus in accordance with one or more principles of the present invention.

FIG. 5 illustrates a portion of an embodiment of a powder coating system incorporating a supply connector arrangement 202 wherein a plurality of supply connectors 204 is arranged in a matrix format. In accordance with the principles of the present invention, any type of arrangement may be employed, such as, for example, arbitrary arrangements and three-dimensional formats. In a preferred embodiment, at least one supply connector is deemed to be a purge connector 206 in fluid communication with a positive or negative pressure source to purge a connected applicator when a moveable delivery connector 208 is connected to the purge connector 206.

Figure 6:
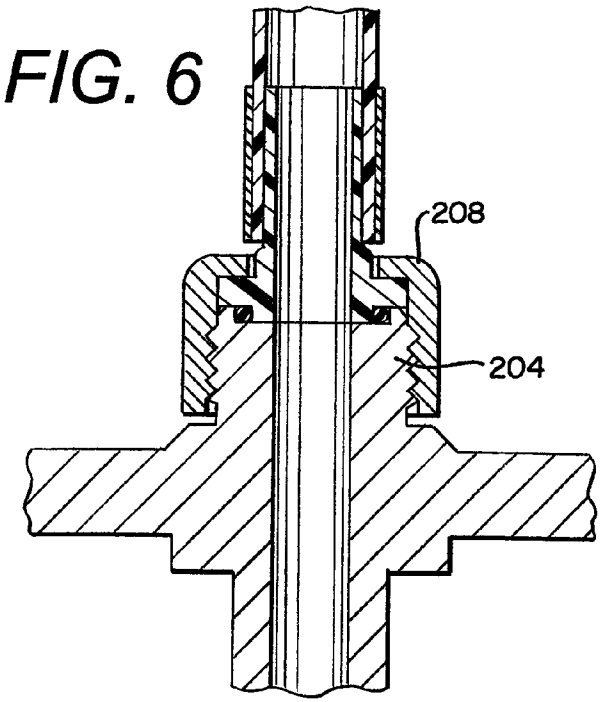
FIG. 6 is a cross-sectional detail view of FIG. 5, showing one of the supply connectors engaged with the delivery connector in accordance with one or more principles of the present invention.

FIG. 6 is a cross-sectional detail view of FIG. 5, illustrating the engagement of one of the supply connectors 204 and the delivery connector 208. Any type of connection arrangement known in the art may be employed to facilitate connection between the delivery connector 208 and the supply connector 204, such as, for example, rubber or elastomeric gasket-type connectors, spring-loaded connectors, magnetic seal connectors, traditional pneumatic connectors, or the like. Some of these connectors may require additional movement mechanisms as understood by one of ordinary skill in the art to facilitate connection. Such mechanisms can be controlled, for example, by the system controller or respond to other movements within the system. Merely by way of example, and without limitation, the supply connector 204 and delivery connector 208 illustrated in FIG. 6 are threaded-type pneumatic connectors, wherein the delivery connector 208 has a female-threaded collar portion that is rotatable to facilitate engagement with a male-threaded portion of the supply connector 204. The rotation of the collar portion may be automated, for example, by any one of a number of movement mechanisms described herein or known in the art.

Figure 7:
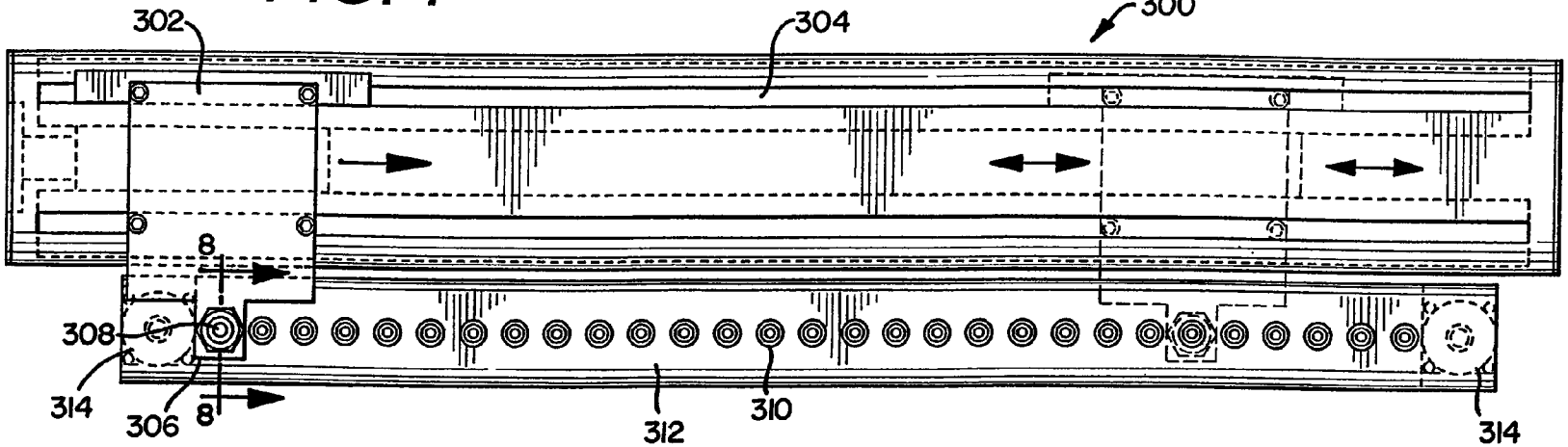
FIG. 7 is a top plan view of yet another embodiment of a connection changer apparatus in accordance with one or more principles of the present invention.
Figure 8:
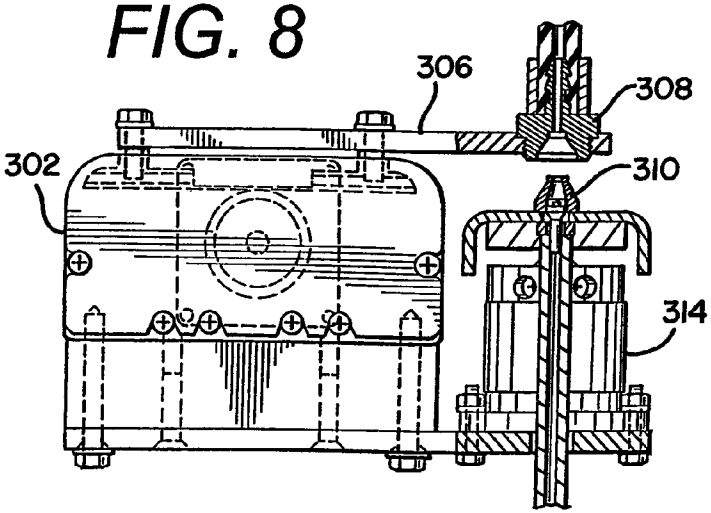
FIG. 8 is an elevational end view of the connection changer apparatus shown in FIG. 7, including a partial cross-sectional view taken along section line 8-8, which shows a delivery connector and a supply connector of a supply connector arrangement in a disengaged state.
Figure 9:
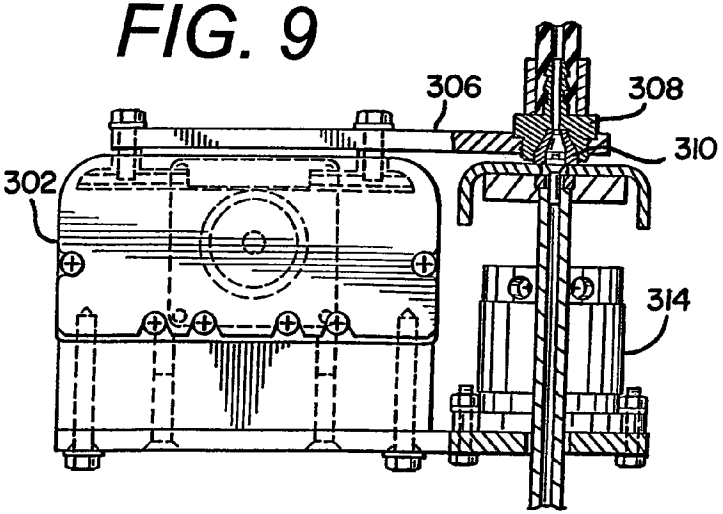
FIG. 9 is an elevational end view of the connection changer apparatus shown in FIG. 7, including a partial cross-sectional view taken along section line 8-8, which shows a delivery connector and a supply connector of a supply connector arrangement in an engaged state.

FIG. 7 illustrates an additional embodiment of a connection changer, in the form of connection changer 300, for use in connection with a powder coating supply system to facilitate fluid connection between the supply portion of the system to the delivery portion of the system. The connection changer 300 includes a carriage member 302 slidingly engaged with a track member 304, which allows the carriage member 302 to move along the directions indicated by the arrows in FIG. 7. The carriage member 302 includes a delivery connector support member 306, which supports a delivery connector 308 for movement with the carriage member 302. As shown in FIG. 7, an arrangement of moveable supply connectors 310 are linearly arranged along a supply connector support member 312 disposed adjacent to the track member 304. The carriage member 302 is moved in a controlled fashion along the track member 304 until it is positioned at a selected supply connector 310. As shown in FIG. 8, when the carriage member 302 is positioned at a supply connector 310, the delivery connector 308 is disposed above the supply connector 310 as supported by the delivery connector support member 306. As shown in FIG. 9, to effectuate connection of the delivery connector 308 to a selected supply connector 310, a pair of cylinders 314 lifts the supply connector support member 312 toward the delivery connector 308, ultimately resulting in engagement of the selected supply connector 310 to the delivery connector 308. The cylinders can be pneumatic, hydraulic, or the like. Alternatively, any other type of lifting arrangement known in the art can be utilized. Furthermore, a single cylinder may also be used in certain embodiments. In this particular arrangement, it is preferable to utilize an elastomeric boot or nipple-type connection arrangement, such as that shown in FIGS. 8 and 9, wherein the cylinder force creates a tight friction seal between the delivery connector 308 and the supply connector 310. This type of connection arrangement does not require additional movement of the connectors apart from the movement caused by the cylinders 314. In some embodiments, however, it may be desirable to utilize a more secure connection arrangement, such as, for example, the automated thread arrangement shown in FIG. 5.

Figure 10:
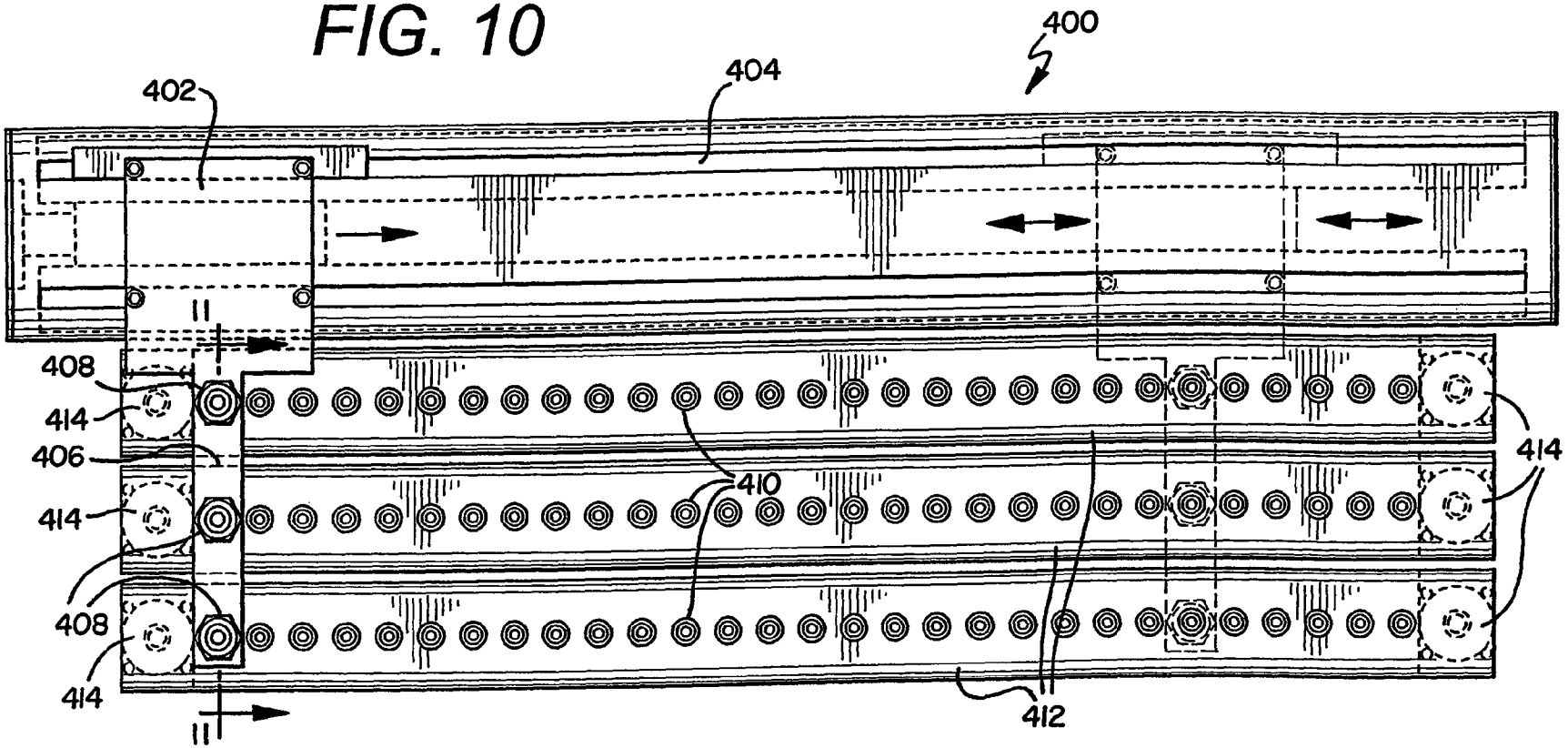
FIG. 10 is a top plan view of yet another embodiment of a connection changer apparatus in accordance with one or more principles of the present invention.
Figure 11:
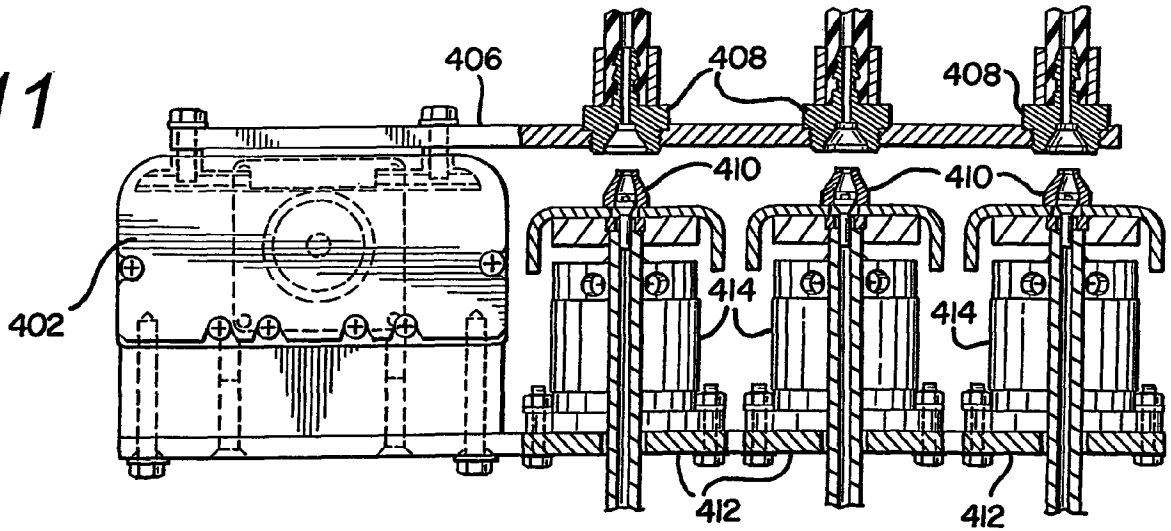
FIG. 11 is an elevational end view of the connection changer apparatus shown in FIG. 10, including a partial cross-sectional view taken along section line 11-11, which shows a delivery connector arrangement and a group of supply connectors of a supply connector arrangement in a disengaged state.
Figure 12:
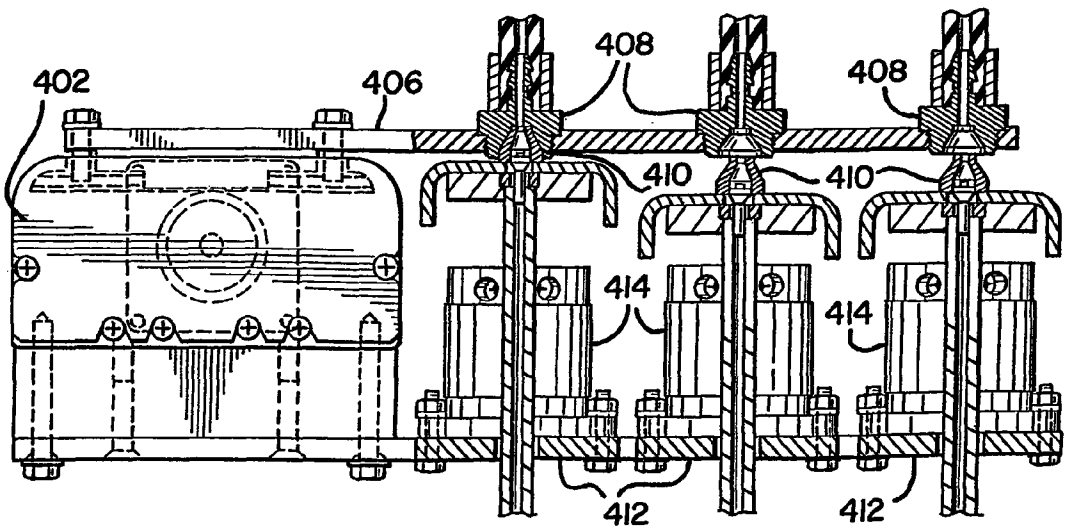
FIG. 12 is an elevational end view of the connection changer apparatus shown in FIG. 10, including a partial cross-sectional view taken along section line 11-11, which shows a delivery connector arrangement and one of a group of supply connectors of a supply connector arrangement in an engaged state.

FIG. 10 illustrates yet another embodiment of a connection changer, in the form of connection changer 400, for use in connection with a powder coating supply system to facilitate fluid connection between the supply portion of the system to the delivery portion of the system. The connection changer 400 is similar to the embodiment illustrated in FIG. 7. In the embodiment shown in FIG. 10, a carriage member 402 is slidingly engaged with a track member 404, which allows the carriage member 402 to move along the directions indicated by the arrows in FIG. 10. The carriage member 402 includes a delivery connector support member 406, which supports a plurality of delivery connectors 408 for movement with the carriage member 402. As shown in FIG. 10, a corresponding plurality of supply connector arrangements of moveable supply connectors 410 are each linearly arranged along a supply connector support member 412 disposed adjacent to the track member 404. As shown in FIG. 11, when the carriage member 406 is positioned at a selected set of supply connectors 410 across the supply connector support members 412, the delivery connectors 408 are disposed above the selected set of supply connectors 410 as supported by the delivery connector support member 406. As shown in FIG. 12, to effectuate connection of the delivery connectors 408 to the selected set of supply connectors 410, a pair of cylinders 414 associated with each supply connector support member 412 lifts the supply connector support member 412 toward the corresponding delivery connector 408, ultimately resulting in engagement of the selected set of supply connectors 410 to the delivery connectors 408. The cylinders can be pneumatic, hydraulic, or the like. Alternatively, any other type of lifting arrangement known in the art can be utilized. Furthermore, a single cylinder may also be used in certain embodiments. In this particular arrangement, each of the plurality of supply connector support members 412 can be selectively moved toward the delivery connectors 408, such that one or more of the supply connectors 410 associated with a common position along each of the supply connector support members 412 can be connected to the delivery connectors 408. In FIG. 12, only one of the supply connectors 410 associated with a common position along each of the supply connector support members 412 is shown in a fully engaged state.

While one or more specific embodiments have been illustrated and described in connection with the present invention, including one or more examples of variations, alternatives, and preferences, it is understood that the present invention should not be limited to any single embodiment or any particular variation, alternative, or preference. Rather, the present invention is to be construed in breadth and scope in accordance with recitation of the appended claims.

What is claimed is:

1. A powder coating system comprising:

a plurality of supply containers;

a connection changer having a plurality of supply connectors arranged in a generally common plane, each of the supply connectors in fluid communication with at least one of the plurality of supply containers and a movable delivery connector selectively and independently connectable to each of the plurality of supply connectors, the connection changer including a first support member supporting the movable delivery connector and allowing axial movement of the moveable delivery connector, wherein the axial movement is transverse to the common plane, a second support member supporting the first support member and allowing lateral movement of the first support member generally parallel to the common plane, and a third support member supporting the second support member and allowing lateral movement of the second support member transverse to the lateral movement of the first support member, wherein fluid communication from the plurality of supply containers to the plurality of supply connectors defines a supply portion of the system;

a pump in fluid communication with the delivery connector of the connection changer; and at least one applicator in fluid communication with the pump, wherein fluid communication from the delivery connector to the applicator defines a delivery portion of the system;

wherein the pump is disposed along the delivery portion of the system between the delivery connector and the at least one applicator to apply negative pressure to the at least one selected supply container and draw its contents to the at least one applicator.

2. The powder coating system of claim 1, further comprising a control unit in communication with at least one of the pump, the connection changer, and the at least one applicator.

3. The powder coating system of claim 1, wherein the connection changer further includes a purge connector in fluid communication with a positive pressure source to purge the at least one applicator when the moveable delivery connector is connected to the purge connector.

4. The powder coating system of claim 1, wherein the plurality of supply connectors are arranged in a common plane and the movable delivery connector is capable of lateral movement parallel to the common plane and axial movement perpendicular to the common plane to effectuate selective connection with the plurality of supply connectors.

5. The powder coating system of claim 1, wherein the pump comprises a dense phase pump.

6. The powder coating system of claim 1, wherein the plurality of supply connectors are arranged in a common plane in a matrix format.

7. The powder coating system of claim 1, wherein the plurality of supply connectors are arranged in a common plane in a linear format.

8. The powder coating system of claim 1, wherein each of the plurality of supply connectors are moveable with respect to the delivery connector to facilitate selective connection therebetween.

9. A powder coating system comprising:

a plurality of supply containers;

a connection changer comprising:

a plurality of supply connectors mounted in a common arrangement and each in fluid communication with at least one of the plurality of supply containers;

a delivery connector disposed adjacent to the plurality of supply connectors and selectively and independently connectable to each of the plurality of supply connectors; and a first movement apparatus for carrying the delivery connector and allowing it to move from one of the plurality of supply connectors to another of the plurality of supply connectors for selective and independent connection of the delivery connector to each of the plurality of supply connectors;

a pump in direct fluid communication with the delivery connector of the connection changer;

a second movement apparatus for carrying the pump relative to the plurality of supply connectors; and at least one applicator in fluid communication with the pump, wherein each of the plurality of supply connectors is movable to facilitate connection to the delivery connector, and wherein the pump is arranged between the delivery connector and the at least one applicator and applies negative pressure to the at least one selected supply container to draw its contents to the at least one applicator.

10. The powder coating system of claim 9, wherein the movement apparatus is a track arrangement.

* * * * *